US009948038B2

(12) United States Patent
Katou et al.

(10) Patent No.: US 9,948,038 B2
(45) Date of Patent: Apr. 17, 2018

(54) CONNECTOR

(71) Applicant: JAPAN AVIATION ELECTRONICS INDUSTRY, LIMITED, Shibuya-ku, Tokyo (JP)

(72) Inventors: Ryou Katou, Tokyo (JP); Takashi Miyashita, Tokyo (JP); Kazuhiko Furukatsu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/047,462

(22) Filed: Feb. 18, 2016

(65) Prior Publication Data

US 2016/0301165 A1 Oct. 13, 2016

(30) Foreign Application Priority Data

Apr. 10, 2015 (JP) ..... 2015-081118

(51) Int. Cl.
*H01R 24/52* (2011.01)
*H01R 24/40* (2011.01)
*H01R 13/52* (2006.01)

(52) U.S. Cl.
CPC ..... *H01R 24/40* (2013.01); *H01R 13/5202* (2013.01); *H01R 24/52* (2013.01)

(58) Field of Classification Search
CPC H01R 24/40; H01R 13/5202; H01R 13/5219; H01R 13/74; H01P 5/085
(Continued)

(56) References Cited

U.S. PATENT DOCUMENTS 3,437,960 A * 4/1969 Ziegler, Jr. ..... H01R 24/44 174/75 C
3,525,973 A * 8/1970 Kipnes ..... 439/353
(Continued)

FOREIGN PATENT DOCUMENTS

EP 2034560 A1 3/2009
JP 05036451 A 2/1993
(Continued)

OTHER PUBLICATIONS

Extended European Search Report dated Aug. 22, 2016, issued in counterpart European Application No. 16156721.9.
(Continued)

*Primary Examiner* — Michael A Lyons
*Assistant Examiner* — Milagros Jeancharles
(74) *Attorney, Agent, or Firm* — Holtz, Holtz & Volek PC

(57) ABSTRACT

A connector comprises an outer member, which is made of resin coated with a conductive plating layer, and an inserted portion, which is inserted into an insertion hole of a case rearward in a front-rear direction when the connector is attached to the case. The outer member has a body portion, a flange and an attached surface which is formed of a rear surface of the body portion and a rear surface of the flange. The flange protrudes from the body portion in a perpendicular plane perpendicular to the front-rear direction. The inserted portion is located inward of the body portion in the perpendicular plane. The rear surface of the body portion is formed with a pressure contact portion which surrounds the inserted portion in the perpendicular plan. The pressure contact portion is formed with a contact surface which is located rearward of the rear surface of the flange.

12 Claims, 9 Drawing Sheets

(58) Field of Classification Search
USPC ..... 439/578, 733.1, 607.27, 750, 335, 449, 439/452, 564, 565, 931, 939, 63
See application file for complete search history.

(56) References Cited

U.S. PATENT DOCUMENTS 4,099,825 A * 7/1978 Jackson ..... H01R 24/542 200/51.1
4,199,736 A * 4/1980 McTaggart ..... H01P 1/10 324/110
4,721,481 A * 1/1988 Grellmann ..... H01R 24/52 439/551
6,019,636 A * 2/2000 Langham ..... H01R 9/0521 439/583
6,305,985 B1 * 10/2001 Akiha ..... H01R 13/6599 428/411.1
6,832,932 B1 * 12/2004 Moseley ..... H01R 13/565 439/578
7,717,743 B2 * 5/2010 Yazawa ..... H01R 13/746 439/578
8,215,847 B2 * 7/2012 Aiudi ..... H01R 13/5219 29/874
8,616,898 B2 * 12/2013 Lee ..... H01R 12/7047 439/63
8,758,049 B2 * 6/2014 Mochizuki ..... H01R 13/527 439/559
9,147,955 B2 * 9/2015 Hanson ..... H01R 13/2421
2002/0042228 A1 4/2002 Yoshioka et al.
2003/0224657 A1 * 12/2003 Malloy ..... H01R 9/0521 439/578
2004/0038587 A1 * 2/2004 Yeung ..... H01P 5/085 439/581
2005/0176292 A1 * 8/2005 Lee ..... H01R 24/44 439/578
2006/0172571 A1 * 8/2006 Montena ..... H01R 9/0518 439/91
2006/0199432 A1 9/2006 Taylor
2008/0261446 A1 * 10/2008 Arnaud ..... H01R 13/6315 439/578
2009/0137150 A1 5/2009 Huang et al.
2013/0029520 A1 1/2013 Lee et al.
2013/0203287 A1 * 8/2013 Natoli ..... H01R 9/0524 439/578

FOREIGN PATENT DOCUMENTS

JP 07053271 Y2 12/1995
JP 09129316 A 5/1997
JP 09306605 A 11/1997
JP 2001052819 A 2/2001
JP 2004273236 A 9/2004
JP 2009016116 A 1/2009

OTHER PUBLICATIONS

European Office Action (in English) dated May 3, 2017 issued in counterpart European Application No. 16156721.9.

* cited by examiner

CONNECTOR

CROSS REFERENCE TO RELATED APPLICATIONS

An applicant claims priority under 35 U.S.C. § 119 of Japanese Patent Application No. JP2015-081118 filed Apr. 10, 2015.

BACKGROUND OF THE INVENTION

This invention relates to a connector attachable to a case formed with an insertion hole.

For example, this type of connector is disclosed in JP Y H07-53271 (Patent Document 1), the content of which is incorporated herein by reference.

Referring to FIG. 17, Patent Document 1 discloses a connector 900 attachable to a conductive case (case) 950 which is made of metal and formed with an insertion hole 952. The connector 900 comprises an inner conductor (contact) 910, an insulating member (holding member) 920 and an outer conductor (outer member) 930 made of metal. The outer conductor 930 has a flange 940. The flange 940 is formed with an annular projection (pressure contact portion) 942. When the connector 900 is attached to the conductive case 950, the inner conductor 910 is inserted into the insertion hole 952, and the flange 940 is fixed to the conductive case 950. At that time, the annular projection 942 is brought into contact with and pressed against the conductive case 950 so that the outer conductor 930 is brought into contact with the conductive case 950 with a high contact pressure. As a result, the outer conductor 930 is connected to the conductive case 950 with electrical stability.

The existing connector such as the connector 900 of Patent Document 1 has a heavy weight because the existing connector comprises the outer member which is made of metal and has the flange. Such existing connector, or its outer member, is required to be reduced in weight while the electrical connection between the outer member and the case is maintained to be stable.

SUMMARY OF THE INVENTION

It is therefore an object of the present invention to provide a connector which is attachable to a case formed with an insertion hole, wherein the connector has a weight lighter than that of the existing connector and has an outer member connectable to the case with electrical stability.

An aspect of the present invention provides a connector attachable to a case formed with an insertion hole. The connector comprises a contact, a holding member, an outer member and an inserted portion. The outer member is made of resin coated with a conductive plating layer. The holding member holds the contact. The outer member, at least in part, accommodates the holding member. The inserted portion is inserted into the insertion hole rearward in a front-rear direction when the connector is attached to the case. The outer member has a body portion, a flange and an attached surface. The flange protrudes from the body portion in a perpendicular plane perpendicular to the front-rear direction. The attached surface is formed of a rear surface of the body portion and a rear surface of the flange. The inserted portion projects rearward beyond the attached surface and is located inward of the body portion in the perpendicular plane. The rear surface of the body portion is formed with a pressure contact portion which surrounds the inserted portion with no break in the perpendicular plane. The pressure contact portion is formed with a contact surface which is located rearward of the rear surface of the flange.

Another aspect of the present invention provides a connector attachable to a case formed with an insertion hole. The connector comprises a contact, a holding member and an outer member. The outer member is made of resin coated with a conductive plating layer. The holding member holds the contact. The outer member, at least in part, accommodates the holding member. The outer member has a body portion, a flange, an inserted portion and a pressure contact portion. The inserted portion is inserted into the insertion hole rearward in a front-rear direction when the connector is attached to the case. The flange protrudes from the body portion in a perpendicular plane perpendicular to the front-rear direction. The inserted portion projects rearward beyond a rear surface of the flange. The body portion is located inward of the inserted portion in the perpendicular plane. The pressure contact portion is formed on a boundary between the rear surface of the flange and the inserted portion in the perpendicular plane and surrounds the inserted portion with no break in the perpendicular plane. The pressure contact portion is formed with a contact surface which is located rearward of the rear surface of the flange.

The outer member of the connector according to the present invention is made of resin coated with a conductive plating layer. The thus-formed outer member enables the connector to be reduced in weight while maintaining electromagnetic shield function thereof.

The outer member according to the present invention can be molded of resin material. In general, the flange of the thus-molded outer member tends to be easily warped. However, the pressure contact portion of one of the connectors of the present invention is formed not on the rear surface of the flange but on the rear surface of the body portion. In other words, the pressure contact portion is located inward of the circumference surface of the body portion in the perpendicular plane. In addition, the pressure contact portion of a remaining one of the connectors of the present invention is formed on the boundary between the rear surface of the flange and the inserted portion in the perpendicular plane. Thus, in each of the connectors according to the present invention, the pressure contact portion is formed so as to be close to the center of the body portion in the perpendicular plane. This structure allows the outer member to be connected to the case with electrical stability even when the flange is warped to be apart from the case.

An appreciation of the objectives of the present invention and a more complete understanding of its structure may be had by studying the following description of the preferred embodiment and by referring to the accompanying drawings.

Figure 1:
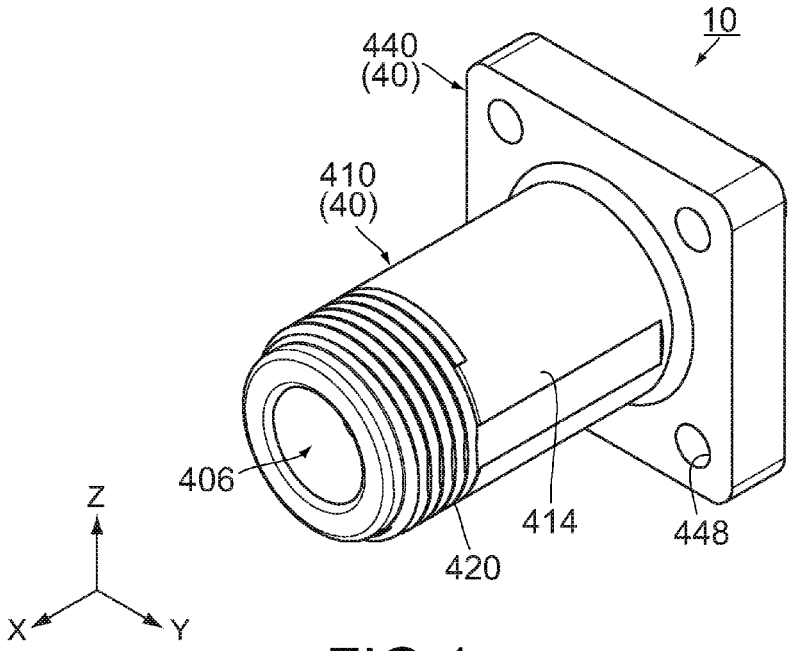
FIG. 1 is a front perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 3:
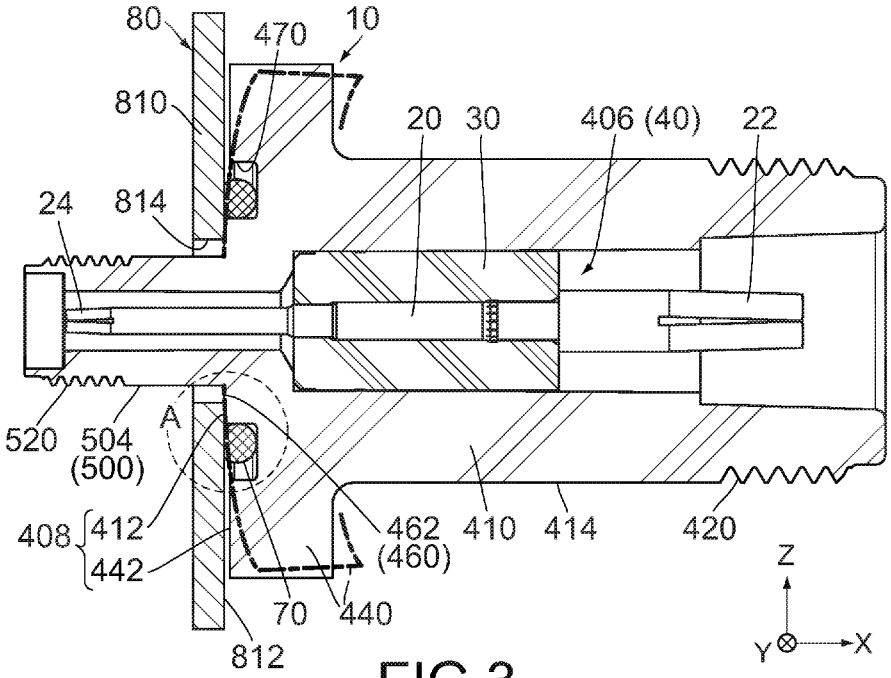
FIG. 3 is a view showing a cross-section of the connector of FIG. 2 except a contact of the connector while showing a side surface of the contact, wherein the connector is attached to a case, and an outline of a warped flange is partially illustrated by chain dotted line.

Referring to FIG. 3, a connector 10 according to a first embodiment of the present invention is attachable to a case 80 which is made of conductor and formed with an insertion hole 814. The case 80 is, for example, a metal case accommodating a circuit board (not shown) and a connection object (not shown) such as a mating connector which is mateable with the connector 10.

As shown in FIG. 3, the case 80 comprises an attachment portion 810 to which the connector 10 is to be attached. The attachment portion 810 according to the present embodiment is a metal plate extending in the YZ-plane (perpendicular plane) and has a front surface 812 (the positive X-side surface) in the X-direction (front-rear direction). The front surface 812 is a plane in parallel to the YZ-plane. The insertion hole 814 is formed in the attachment portion 810 and pierces the attachment portion 810 in the X-direction.

Figure 2:
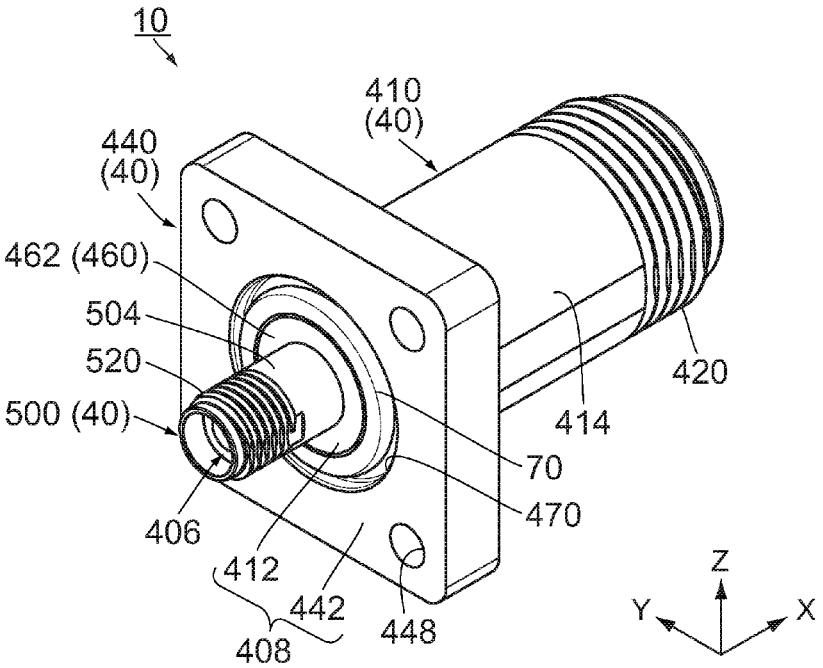
FIG. 2 is a rear perspective view showing the connector of FIG. 1.

Referring to FIGS. 1 to 3, the connector 10 according to the present embodiment is a coaxial connector. The connector 10 comprises a contact 20 made of conductor, a holding member 30 made of insulator and an outer member 40 made of resin coated with a conductive plating layer 404.

The outer member 40 has a body portion 410, a flange 440 and an inserted portion 500. The body portion 410 roughly has a cylindrical shape which extends along the X-direction. The flange 440 is provided at a rear end (the negative X-side end) of the body portion 410. The flange 440 protrudes from the body portion 410 in the perpendicular plane (the YZ-plane) perpendicular to the front-rear direction (the X-direction) and roughly has a rectangular shape in the YZ-plane. The inserted portion 500 roughly has a cylindrical shape which extends rearward (in the negative X-direction) from a rear end of the body portion 410.

According to the present embodiment, the inserted portion 500 is a part of the outer member 40. In other words, the connector 10 comprises the inserted portion 500 which is formed integrally with the outer member 40. However, as explained later, the outer member 40 and the inserted portion 500 may be formed separately from each other.

The outer member 40 has an accommodation portion 406 formed inside thereof. The accommodation portion 406 is a space which passes through the body portion 410 and the inserted portion 500 in the X-direction to have openings at a front end (the positive X-side end) and a rear end of the outer member 40.

Figure 4:
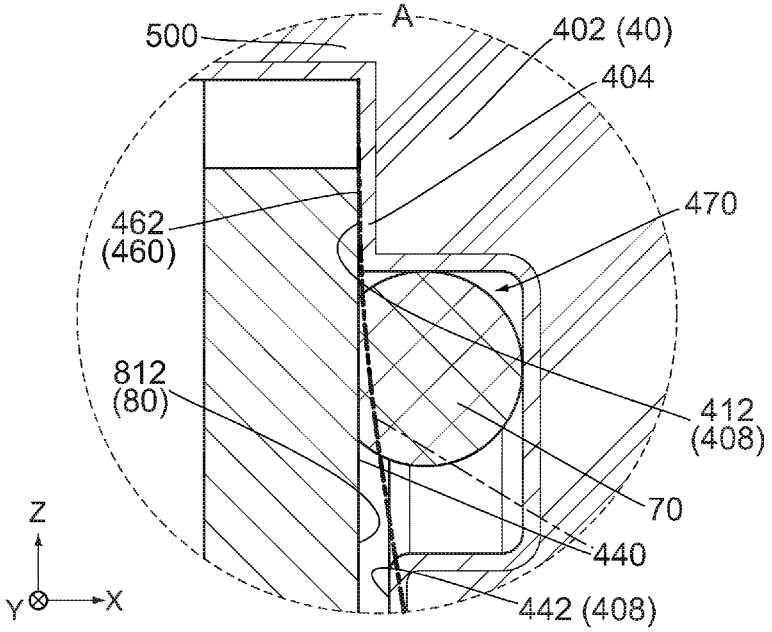
FIG. 4 is an enlarged, cross-sectional view showing a part of the connector and a part of the case (the parts enclosed by dashed line A) of FIG. 3, wherein a conductive plating layer of an outer member of the connector is schematically illustrated, and the outline of the warped flange is partially illustrated by chain dotted line.
Figure 17:
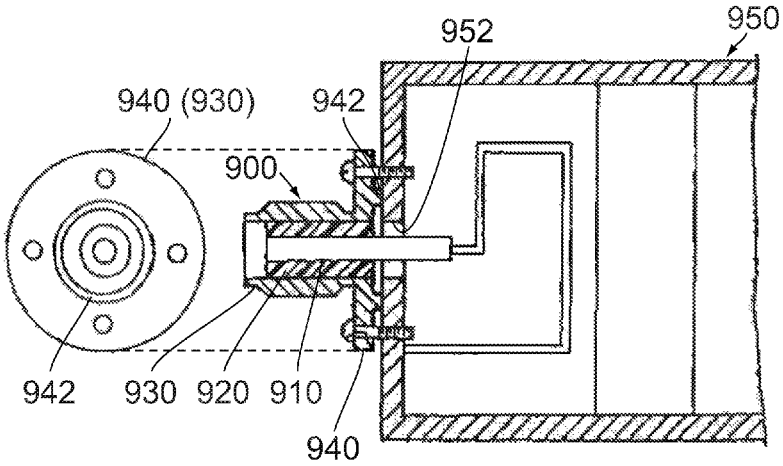
FIG.17 PRIOR ART
FIG. 17 is a combination of a cross-sectional view and a rear view, wherein the cross-sectional view shows a connector and a case of Patent Document 1, and the rear view shows the connector.

Referring to FIG. 4, the outer member 40 is formed of a base portion 402 and the conductive plating layer 404, wherein the base portion 402 is made of insulating resin, and the conductive plating layer 404 is, for example, a nickel plate coated on a surface of the base portion 402. The outer member 40 has a light weight because the most part of the volume of the outer member 40 is the base portion 402 made of resin. The connector 10 can be therefore reduced in weight. Moreover, the conductive plating layer 404 made of conductor covers the whole surface of the base portion 402 including an inner surface of the inside of the base portion 402 where the accommodation portion 406 is formed. The outer member 40 therefore functions as a conductive shell by itself. In other words, the outer member 40 has an electromagnetic shield ability comparable to that of the existing outer member made of metal (see FIG. 17).

As shown in FIG. 3, the contact 20 extends in the X-direction to be formed with a connection portion 22 and a connection portion 24 which are located at opposite ends of the contact 20 in the X-direction, respectively. The connection portion 22 is a part which is to be connected to a connection object (not shown) outside of the case 80 while the connection portion 24 is a part which is to be connected to another connection object (not shown) inside of the case 80. The contact 20 has a middle part in the X-direction which is surrounded and held by the holding member 30. In other words, the holding member 30 holds the contact 20. The holding member 30 is accommodated in the accommodation portion 406 while holding the contact 20. In other words, the outer member 40, at least in part, accommodates the holding member 30 so that insulation between the outer member 40 and the contact 20 is kept.

As shown in FIGS. 2 and 3, the body portion 410 has a rear surface 412 located at the rear end thereof, and the flange 440 has a rear surface 442 located at a rear end thereof. Accordingly, the outer member 40 has an attached surface 408 which is formed of the rear surface 412 of the body portion 410 and the rear surface 442 of the flange 440. The inserted portion 500 projects rearward beyond the attached surface 408 and is located inward of the body portion 410 in the YZ-plane.

As shown in FIGS. 1 to 3, the body portion 410 has a circumference surface 414 formed on a circumference thereof in the YZ-plane. The circumference surface 414 is formed with a screw 420 which is located in the vicinity of a front end thereof and is used when the connector 10 is connected to the connection object (not shown) outside of the case 80. As shown in FIGS. 1 and 2, the flange 440 has four attached holes 448 formed at four corners thereof, respectively. The attached holes 448 pierce the flange 440 in the X-direction. As shown in FIGS. 2 and 3, the inserted portion 500 has a circumference surface 504 formed on a circumference thereof in the YZ-plane. The circumference surface 504 is formed with a screw 520 which is located in the vicinity of a rear end thereof and is used when the connector 10 is connected to the connection object (not shown) inside of the case 80.

As shown in FIGS. 2 to 4, the rear surface 412 of the body portion 410 is formed with a pressure contact portion 460 and an accommodation ditch 470. The pressure contact portion 460 surrounds the inserted portion 500 with no break in the YZ-plane. In addition, the whole of the pressure contact portion 460 projects rearward beyond the rear surface 442 of the flange 440. The thus-projecting pressure contact portion 460 is formed with a contact surface 462 which is located rearward of the rear surface 442 of the flange 440. The accommodation ditch 470 is a ditch recessed forward (in the positive X-direction) while surrounding the pressure contact portion 460 with no break in the YZ-plane. The accommodation ditch 470 accommodates a sealing member 70 made of elastomer. The sealing member 70 according to the present embodiment is an O-ring.

Referring to FIGS. 2 and 3, when the connector 10 is attached to the case 80, the inserted portion 500 is inserted into the insertion hole 814 of the case 80 rearward in the X-direction, and the flange 440 is attached and fixed to the attachment portion 810 of the case 80 by threaded bolts screwed through the attached holes 448. Meanwhile, the attached surface 408 of the outer member 40 either faces the front surface 812 of the case 80 in the X-direction or is brought into contact with the front surface 812 of the case 80 in the X-direction. Under a state where the connector 10 is attached to the case 80, the contact surface 462 of the pressure contact portion 460 is brought into contact with and pressed against the front surface 812.

Referring to FIGS. 3 and 4, the pressure contact portion 460 is formed not on the rear surface 442 of the flange 440 but on the rear surface 412 of the body portion 410. The pressure contact portion 460 is therefore located inward of the circumference surface 414 in the YZ-plane. In other words, the pressure contact portion 460 is formed so as to be close to the center of the body portion 410 in the YZ-plane. As a result, even when the flange 440 is bent forward, or warped to be apart from the front surface 812 of the case 80 (see chain dotted line in each of FIGS. 3 and 4), the location of the contact surface 462 in the X-direction is hardly changed. Moreover, under a state where the flange 440 is bent rearward, or bent toward the front surface 812 of the case 80, a part of the rear surface 442 of the flange 440 is brought into contact with and pressed against the front surface 812 even if the contact surface 462 is not brought into contact with the front surface 812. The outer member 40 of the connector 10 can be therefore connected to the case 80 with electrical stability.

In particular, the pressure contact portion 460 of the present embodiment is formed on a boundary between the rear surface 412 of the body portion 410 and the inserted portion 500 in the YZ-plane. In other words, the pressure contact portion 460 is formed so as to be as close as possible to the center of the body portion 410 in the YZ-plane. Therefore, even when the flange 440 is bent forward, the contact surface 462 is hardly affected by the bent.

Moreover, the contact surface 462 of the present embodiment is a surface perpendicular to the X-direction. Accordingly, the contact surface 462 is brought into surface contact with the front surface 812 of the case 80. As a result, the electrical connection between the outer member 40 and the case 80 becomes further stable.

Referring to FIG. 2, when the connector 10 is not attached to the case 80 (see FIG. 3), the sealing member 70 projects rearward beyond the rear surface 412 of the body portion 410. As shown in FIGS. 3 and 4, when the connector 10 is attached to the case 80, the sealing member 70 is pressed against the front surface 812 of the case 80 to be elastically deformed and seals a gap between the connector 10 and the front surface 812. The thus-deformed sealing member 70 prevents water from invading between the connector 10 and the case 80.

As can be seen from FIGS. 3 and 4, since the recessed accommodation ditch 470 surrounds the pressure contact portion 460, the pressure contact portion 460 is relatively unaffected by the warp of the flange 440. Thus, the accommodation ditch 470 contributes to the stabilization of the electrical connection between the outer member 40 and the case 80 to some extent. However, in a case where the waterproof between the connector 10 and the case 80 is not required, the accommodation ditch 470 does not need to be provided. Moreover, the accommodation ditch 470 may be formed not on the rear surface 412 of the body portion 410 but on the rear surface 442 of the flange 440. In other words, the accommodation ditch 470 may be formed on the attached surface 408. Moreover, the shape of the accommodation ditch 470 in the YZ-plane does not need to be a circle, and the sealing member 70 does not need to be the O-ring.

According to the present embodiment, the rear surface 412 of the body portion 410 includes a predetermined part on which the accommodation ditch 470 is not formed, and the whole of this predetermined part functions as the pressure contact portion 460. However, the present invention is not limited thereto. For example, the pressure contact portion 460 may be located to be apart from the accommodation ditch 470 in the YZ-plane. The pressure contact portion 460 and the accommodation ditch 470 which are thus separated from each other may be provided with a surface therebetween, wherein this surface may be located at a position same as that of the rear surface 442 of the flange 440 in the X-direction.

The present invention is not limited to the aforementioned embodiment but is variously applicable. Hereafter, explanation will be made about various embodiments of the present invention while showing modifications of the connector 10. In the following embodiments, members and portions same as the already-explained members and portions have reference signs identical to those of the already-explained members and portions, and explanation about the already-explained members and portions will be made only as necessary.

Second Embodiment

Figure 5:
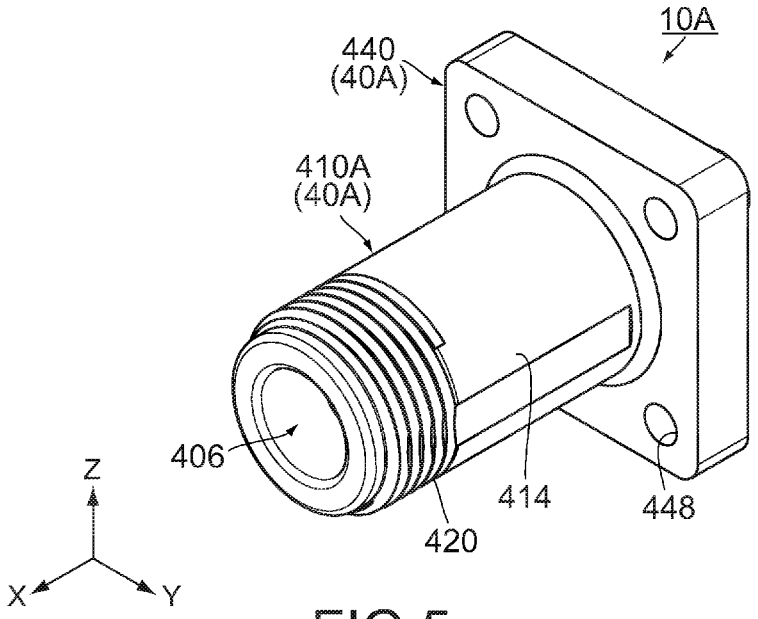
FIG. 5 is a front perspective view showing a connector according to a second embodiment of the present invention.
Figure 6:
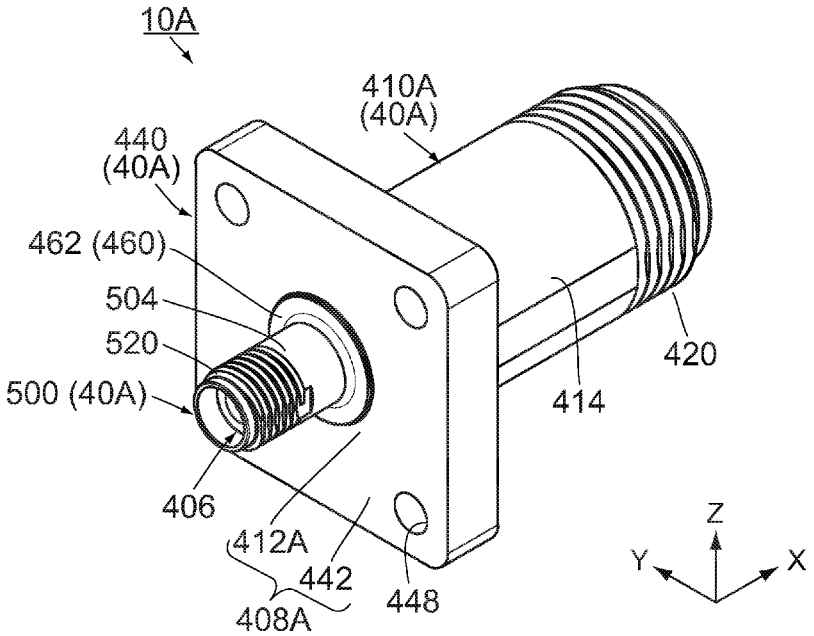
FIG. 6 is a rear perspective view showing the connector of FIG. 5.
Figure 7:
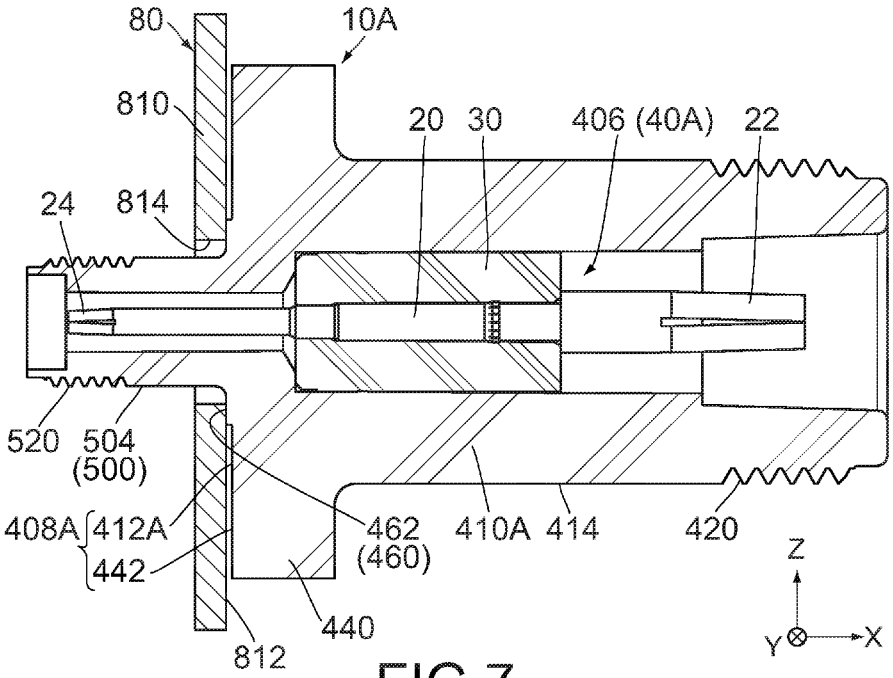
FIG. 7 is a view showing a cross-section of the connector of FIG. 6 except a contact of the connector while showing a side surface of the contact, wherein the connector is attached to a case.

Referring to FIGS. 5 to 7 together with FIGS. 1 to 3, a connector 10A according to a second embodiment of the present invention is attachable to the case 80 formed with the insertion hole 814 similar to the connector 10. The connector 10A comprises the contact 20 and the holding member 30 same as those of the connector 10 while comprising an outer member 40A slightly different from the outer member 40 of the connector 10. The outer member 40A is made of resin coated with the conductive plating layer 404 similar to the outer member 40. Moreover, the outer member 40A has the flange 440 and the inserted portion 500 similar to the outer member 40. However, the outer member 40A has a body portion 410A slightly different from the body portion 410 of the outer member 40.

The body portion 410A roughly has a cylindrical shape which extends along the X-direction similar to the body portion 410. The body portion 410A has a rear surface 412A located at a rear end thereof. Thus, the outer member 40A has an attached surface 408A formed of the rear surface 412A of the body portion 410A and the rear surface 442 of the flange 440.

As shown in FIGS. 6 and 7, the rear surface 412A of the body portion 410A is formed with the pressure contact portion 460 but is not formed with the accommodation ditch 470 (see FIG. 2). The rear surface 412A includes a predetermined part on which the pressure contact portion 460 is not formed, and this predetermined part is flush with the rear surface 442 of the flange 440. In addition, the inserted portion 500 has a circumference portion in the YZ-plane which is formed with a gently curved portion. This curved portion is located at a boundary between the inserted portion 500 and the pressure contact portion 460.

As can be seen from FIG. 7, also according to the present embodiment, the electrical connection between the outer member 40A of the connector 10A and the case 80 can be improved while the connector 10A can be reduced in weight.

Figure 8:
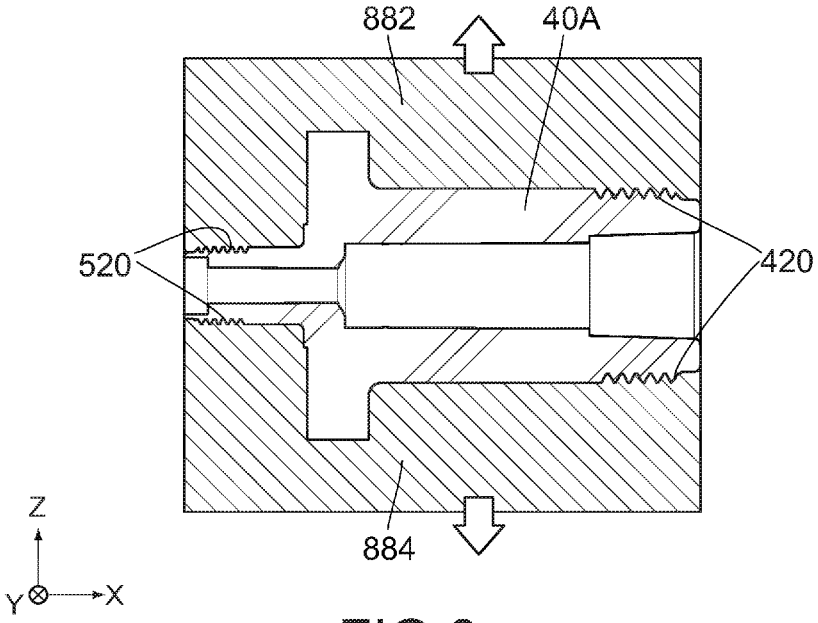
FIG. 8 is a view used for explanation of a forming method of an outer member of the connector of FIG. 5.

Moreover, referring to FIGS. 7 and 8, the outer member 40A has the screw 420 formed on the circumference surface 414 of the body portion 410A and the screw 520 formed on the circumference surface 504 of the inserted portion 500 while having no part recessed in the X-direction. The outer member 40A therefore can be molded with use of only two metal molds 882 and 884. More specifically, the metal molds 882 and 884 may be used to mold resin into a shape of the outer member 40A, and subsequently, the metal molds 882 and 884 may be moved vertically, or moved in the positive Z-direction and the negative Z-direction, respectively, in an up-down direction (the Z-direction). The thus formed outer member 40A may be plated with the conductive plating layer 404, and subsequently, the contact 20 held by the holding member 30 may be inserted from a front end of the accommodation portion 406 thereinto.

Although the outer member 40A of the connector 10A according to the present embodiment has the screw 420 and the screw 520 as described above, the outer member 40A can be easily made with use of the only two metal molds 882 and 884.

Third Embodiment

Figure 9:
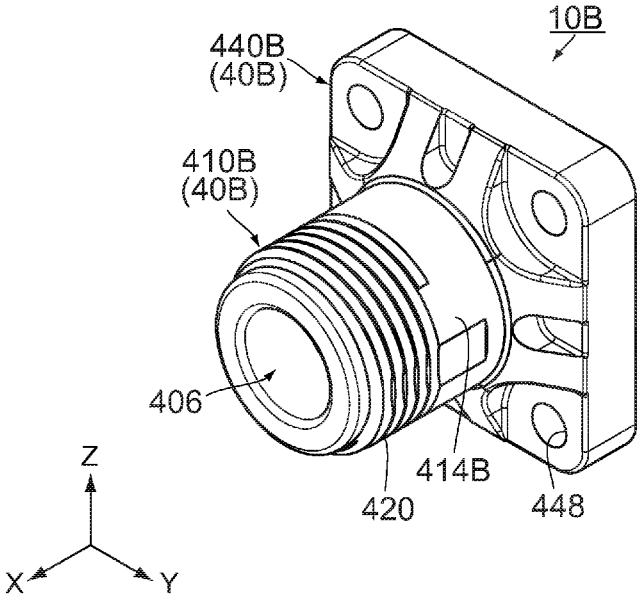
FIG. 9 is a front perspective view showing a connector according to a third embodiment of the present invention.
Figure 10:
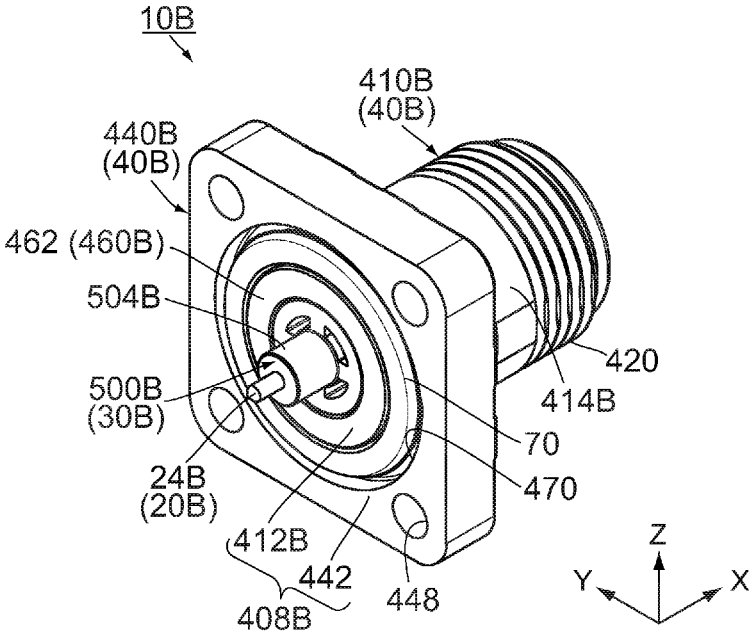
FIG. 10 is a rear perspective view showing the connector of FIG. 9.
Figure 11:
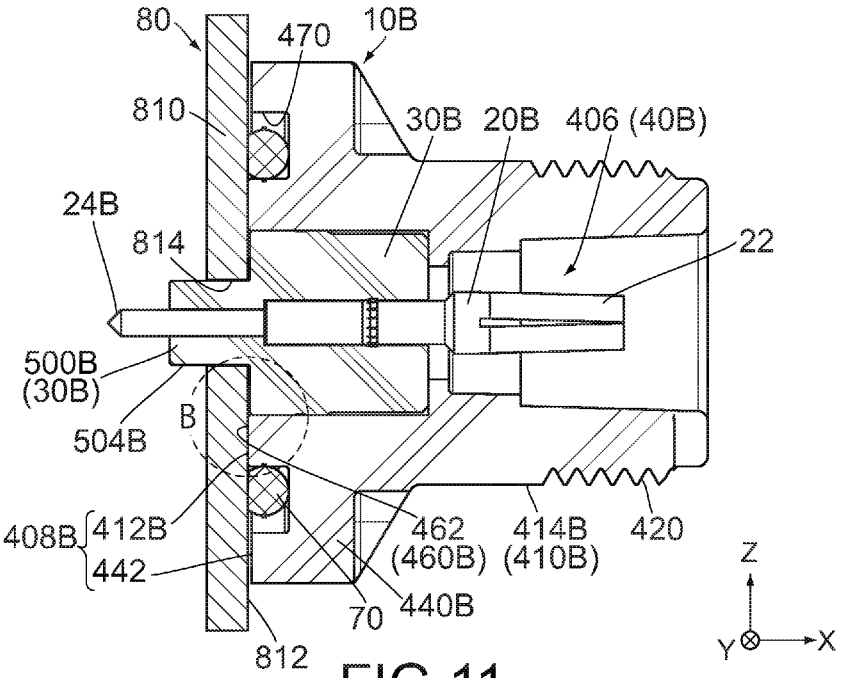
FIG. 11 is a view showing a cross-section of the connector of FIG. 10 except a contact of the connector while showing a side surface of the contact, wherein the connector is attached to a case.

Referring to FIG. 11, a connector 10B according to a third embodiment of the present invention is attachable to the case 80 formed with the insertion hole 814 similar to the connector 10 (see FIG. 3). The connector 10B is formed of members slightly different from those of the connector 10 while having a basic structure similar to that of the connector 10. Specifically, as shown in FIGS. 9 to 11, the connector 10B comprises a contact 20B made of conductor, a holding member 30B made of insulator and an outer member 40B made of resin coated with the conductive plating layer 404. The connector 10B has the accommodation portion 406 formed inside of the outer member 40B similar to the connector 10. The accommodation portion 406 passes through the outer member 40B in the X-direction to have openings at a front end and a rear end of the outer member 40B.

As shown in FIG. 11, the contact 20B extends in the X-direction and is formed with the connection portion 22 and a connection portion 24B which are located at opposite ends of the contact 20B in the X-direction, respectively. The connection portion 24B is a part which is to be connected to the connection object (not shown) inside of the case 80.

The holding member 30B holds a middle part of the contact 20B in the X-direction similar to the holding member 30 (see FIG. 3). Moreover, the outer member 40B, at least in part, accommodates the holding member 30B, which holds the contact 20B, in the accommodation portion 406 so that insulation between the outer member 40B and the contact 20B is kept. Unlike the holding member 30, the holding member 30B has an inserted portion 500B. In other words, the inserted portion 500B according to the present embodiment is not a part of the outer member 40B but a part of the holding member 30B. In detail, the inserted portion 500B is a part of the holding member 30B projecting rearward from another part of the holding member 30B which is accommodated within the accommodation portion 406. The inserted portion 500B roughly has a cylindrical shape similar to the inserted portion 500 (see FIG. 3).

Referring to FIGS. 10 and 11, when the connector 10B is attached to the case 80, the inserted portion 500B is inserted into the insertion hole 814 of the case 80 rearward in the X-direction similar to the inserted portion 500 (see FIG. 3). As described above, the inserted portion 500B according to the present embodiment is formed separately from the outer member 40B while being formed integrally with the holding member 30B. However, the inserted portion 500B may be formed separately from the holding member 30B.

As shown in FIGS. 9 to 11, the outer member 40B has a body portion 410B and a flange 440B. The body portion 410B roughly has a cylindrical shape which extends along the X-direction similar to the body portion 410 (see FIG. 1). Similar to the flange 440 (see FIG. 1), the flange 440B protrudes from a rear end of the body portion 410B in the YZ-plane and roughly has a rectangular shape in the YZ-plane.

Figure 12:
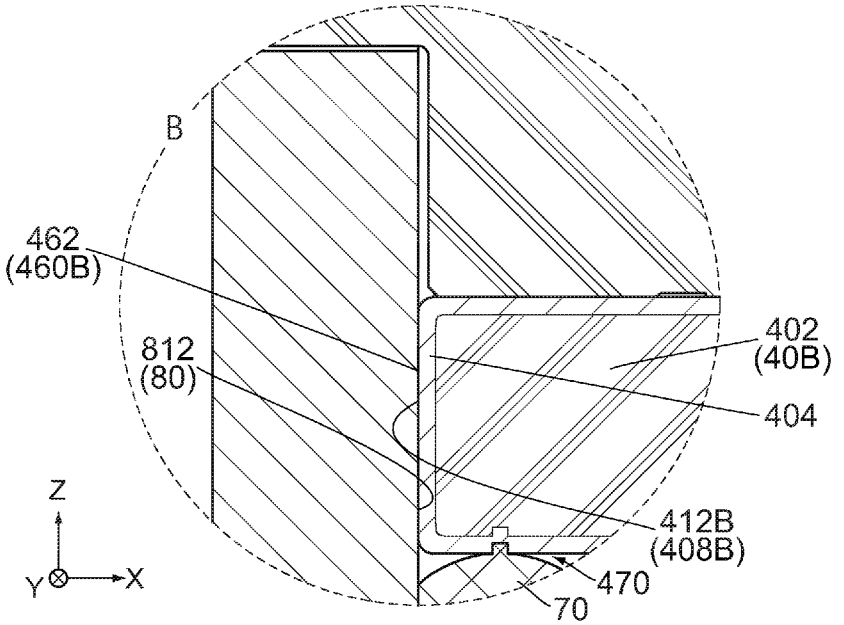
FIG. 12 is an enlarged, cross-sectional view showing a part of the connector and a part of the case (the parts enclosed by dashed line B) of FIG. 11, wherein a conductive plating layer of an outer member of the connector is schematically illustrated.

Referring to FIG. 12, the outer member 40B is formed of the base portion 402 and the conductive plating layer 404 similar to the outer member 40 (see FIG. 4). The connector 10B can be therefore reduced in weight while comprising the outer member 40B which has satisfactory electromagnetic shield ability.

As shown in FIGS. 10 and 11, the body portion 410B has a rear surface 412B located at the rear end thereof, and the flange 440B has the rear surface 442 similar to the flange 440 (see FIG. 2). Accordingly, the outer member 40B has an attached surface 408B which is formed of the rear surface 412B and the rear surface 442. The inserted portion 500B of the holding member 30B projects rearward beyond the attached surface 408B to be located rearward of the attached surface 408B, and is located inward of the body portion 410B in the YZ-plane. The body portion 410B has a circumference surface 414B formed on a circumference thereof in the YZ-plane, and the inserted portion 500B has a circumference surface 504B formed on a circumference thereof in the YZ-plane. The circumference surface 414B is formed with the screw 420 which is located in the vicinity of a front end thereof similar to the circumference surface 414 (see FIG. 2). In contrast, the circumference surface 504B is formed with no screw.

As shown in FIGS. 10 to 12, the attached surface 408B is formed with a pressure contact portion 460B and the accommodation ditch 470. In detail, the pressure contact portion 460B is formed on the rear surface 412B of the body portion 410B, and the accommodation ditch 470 is formed at a boundary portion between the rear surface 412B of the body portion 410B and the rear surface 442 of the flange 440B. Similar to the pressure contact portion 460 (see FIG. 2), the pressure contact portion 460B surrounds the inserted portion 500 with no break in the YZ-plane while projecting rearward beyond the rear surface 442 of the flange 440B. The pressure contact portion 460B is formed with the contact surface 462 which is located rearward of the rear surface 442 of the flange 440B similar to the pressure contact portion 460.

Referring to FIGS. 10 and 11, the connector 10B can be attached to the case 80 by threaded bolts screwed through the attached holes 448 of the flange 440B similar to the connector 10 (see FIGS. 2 and 3). Under a state where the connector 10B is attached to the case 80, the contact surface 462 of the pressure contact portion 460B is brought into contact with and pressed against the front surface 812.

Referring to FIGS. 11 and 12, the pressure contact portion 460B is formed not on the rear surface 442 of the flange 440B but on the rear surface 412B of the body portion 410B similar to the pressure contact portion 460 (see FIGS. 3 and 4). In other words, the pressure contact portion 460B is formed so as to be close to the center of the body portion 410B in the YZ-plane. As a result, even under a state where the flange 440B is bent forward or rearward, the contact surface 462 or a part of the rear surface 442 of the flange 440B is brought into contact with and pressed against the front surface 812. The outer member 40B of the connector 10B can be therefore connected to the case 80 with electrical stability.

In particular, the pressure contact portion 460B of the present embodiment is formed on an innermost part of the rear surface 412B of the body portion 410B in the YZ-plane. In other words, the pressure contact portion 460B is formed so as to be as close as possible to the center of the body portion 410B in the YZ-plane. The contact surface 462 is therefore hardly affected even when the flange 440B is bent forward. Moreover, the contact surface 462 is a surface perpendicular to the X-direction and is therefore brought into surface contact with the front surface 812 of the case 80. As a result, the electrical connection between the outer member 40B and the case 80 becomes further stable. Moreover, since the recessed accommodation ditch 470 surrounds the pressure contact portion 460B, the pressure contact portion 460B is relatively unaffected by the warp of the flange 440B.

According to the present embodiment, the rear surface 412B of the body portion 410B includes a predetermined part on which the accommodation ditch 470 is not formed, and the whole of this predetermined part is the pressure contact portion 460B. However, the present invention is not limited thereto. For example, there may be a surface provided between the pressure contact portion 460B and the accommodation ditch 470, wherein this surface may be located at a position same as that of the rear surface 442 of the flange 440B in the X-direction.

Fourth Embodiment

Figure 14:
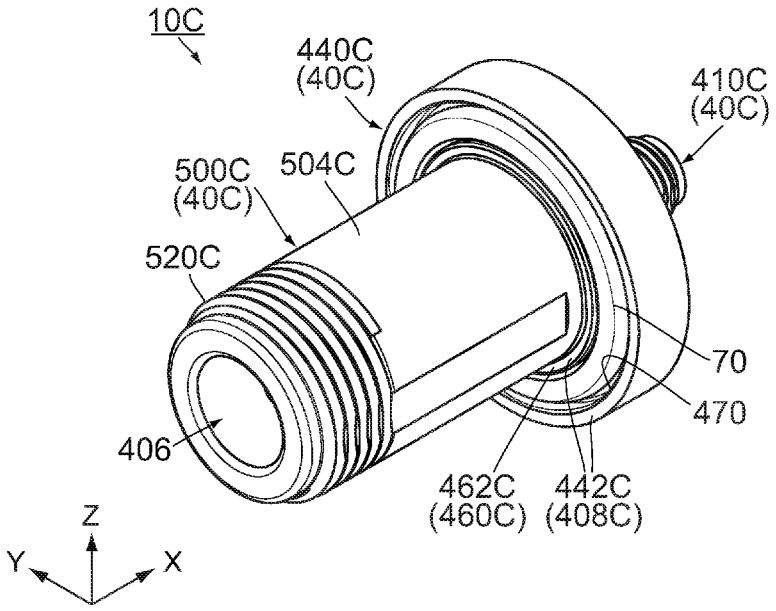
FIG. 14 is a rear perspective view showing the connector of FIG. 13.
Figure 15:
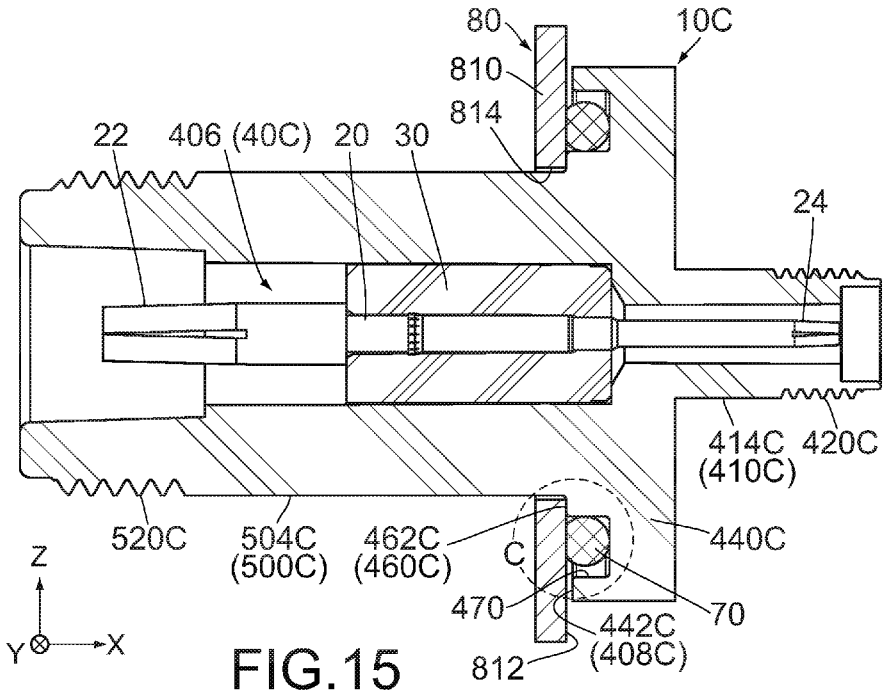
FIG. 15 is a view showing a cross-section of the connector of FIG. 14 except a contact of the connector while showing a side surface of the contact, wherein the connector is attached to a case.

Referring to FIG. 15, a connector 10C according to a forth embodiment of the present invention is attachable to the case 80 formed with the insertion hole 814 similar to the connector 10 (see FIG. 3). Under a state where the front surface 812 of the case 80 is located at the positive X-side of the case 80 (i.e. under the state shown in each of FIGS. 3 and 15), the connector 10C has a shape similar to that of the connector 10 which is reversed in the front-rear direction. Specifically, as shown in FIGS. 12 to 15, the connector 10C comprises the contact 20, the holding member 30 and an outer member 40C made of resin coated with the conductive plating layer 404. In addition, the connector 10C has the accommodation portion 406 formed inside of the outer member 40C similar to the connector 10. The accommodation portion 406 passes through the outer member 40C in the X-direction to have openings at a front end and a rear end of the outer member 40C.

As shown in FIG. 15, the contact 20 of the connector 10C is reversed in the front-rear direction but has a structure same as that of the contact 20 (see FIG. 3) of the connector 10. Similarly, the holding member 30 of the connector 10C is reversed in the front-rear direction but has a structure same as that of the holding member 30 (see FIG. 3) of the connector 10. The holding member 30 holds the contact 20. Moreover, the outer member 40C, at least in part, accommodates the holding member 30 in the accommodation portion 406.

Figure 16:
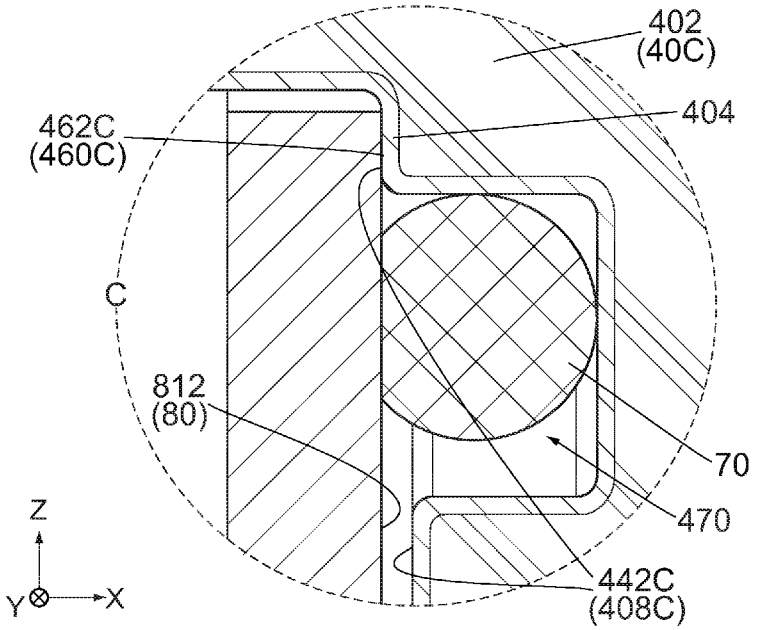
FIG. 16 is an enlarged, cross-sectional view showing a part of the connector and a part of the case (the parts enclosed by dashed line C) of FIG. 15, wherein a conductive plating layer of an outer member of the connector is schematically illustrated.

Referring to FIG. 16, the outer member 40C is formed of the base portion 402 and the conductive plating layer 404 similar to the outer member 40 (see FIG. 4). The connector 10C can be therefore reduced in weight while comprising the outer member 40C which has satisfactory electromagnetic shield ability.

Figure 13:
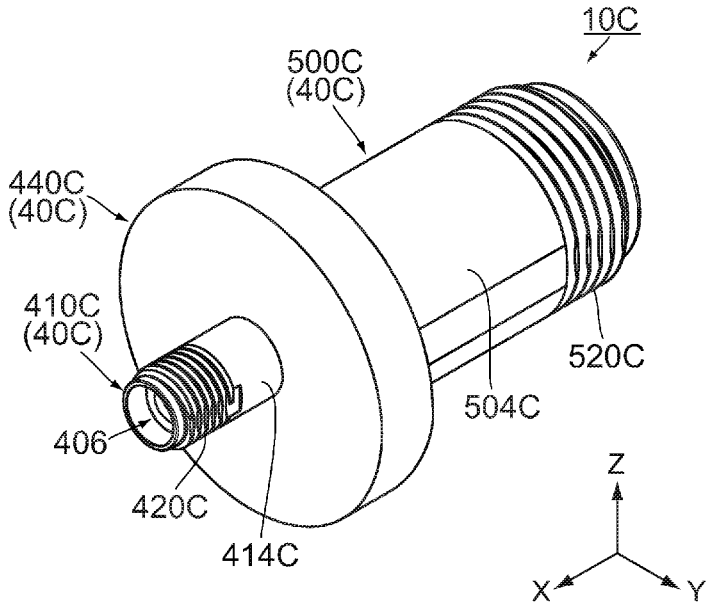
FIG. 13 is a front perspective view showing a connector according to a forth embodiment of the present invention.

As shown in FIGS. 13 to 15, the outer member 40C has a shape similar to that of the outer member 40 (see FIG. 2) which is reversed in the front-rear direction. In detail, the outer member 40C has a body portion 410C, a flange 440C and an inserted portion 500C. The body portion 410C roughly has a cylindrical shape which extends along the X-direction similar to the inserted portion 500 (see FIG. 2). The flange 440C protrudes from a rear end of the body portion 410C in the YZ-plane similar to the flange 440 (see FIG. 1). However, the flange 440C roughly has a circular shape in the YZ-plane unlike the flange 440. The inserted portion 500C roughly has a cylindrical shape which extends rearward from a rear end of the body portion 410C similar to the body portion 410 (see FIG. 1). The inserted portion 500C according to the present embodiment is a part of the outer member 40C. In other words, the connector 10C comprises the inserted portion 500C integrally formed with the outer member 40C.

As shown in FIGS. 14 and 15, the flange 440C has a rear surface 442C located at a rear end thereof. Accordingly, the outer member 40C has an attached surface 408C which is formed only of the rear surface 442C. The inserted portion 500C projects rearward beyond the rear surface 442C of the flange 440C. As shown in FIGS. 13 and 15, the body portion 410C is located inward of the inserted portion 500C in the YZ-plane. The body portion 410C has a circumference surface 414C formed on a circumference thereof in the YZ-plane, and the inserted portion 500C has a circumference surface 504C formed on a circumference thereof in the YZ-plane. The circumference surface 414C is formed with a screw 420C which is located in the vicinity of a front end thereof, and the circumference surface 504C is formed with a screw 520C which is located in the vicinity of a rear end thereof.

As shown in FIGS. 14 to 16, the rear surface 442C of the flange 4400 is formed with a pressure contact portion 460C and the accommodation ditch 470. In other words, the outer member 40C has the pressure contact portion 460C and the accommodation ditch 470. The pressure contact portion 460C surrounds the inserted portion 500C with no break in the YZ-plane while projecting rearward beyond the rear surface 442C of the flange 440C. The pressure contact portion 460C is formed with a contact surface 462C which is located rearward of the rear surface 442C of the flange 4400.

Referring to FIGS. 14 and 15, when the connector 10C is attached to the case 80, the inserted portion 500C is inserted into the insertion hole 814 of the case 80 rearward in the X-direction similar the inserted portion 500 (see FIG. 3). At that time, the flange 440C is pressed against and fixed to the case 80, for example, by heads of bolts (not shown) which are screwed into fixing holes (not shown) formed in the attachment portion 810. Under a state where the connector 10C is attached to the case 80, the contact surface 462C of the pressure contact portion 460C is brought into contact with and pressed against the front surface 812.

Referring to FIGS. 15 and 16, the pressure contact portion 460C is formed on a boundary between the rear surface 442C of the flange 440C and the inserted portion 500C in the YZ-plane. In other words, the pressure contact portion 460C is formed so as to be as close as possible to the center of the body portion 410C in the YZ-plane. The contact surface 462C is therefore hardly affected even when the flange 440C is bent forward. Even under a state where the flange 440C is bent forward or rearward, the contact surface 462C or a part of the rear surface 442C of the flange 440C is brought into contact with and pressed against the front surface 812. The outer member 40C of the connector 10C can be therefore connected to the case 80 with electrical stability.

Moreover, the contact surface 462C is a surface perpendicular to the X-direction and is therefore brought into surface contact with the front surface 812 of the case 80. As a result, the electrical connection between the outer member 40C and the case 80 becomes further stable. Moreover, since the recessed accommodation ditch 470 surrounds the pressure contact portion 460C with no break in the YZ-plane, a part of the flange 440C, which is provided with the pressure contact portion 460C, is relatively unbendable.

The aforementioned embodiments can be further variously modified. For example, each of the shape of the body portion of the connector and the shape of the inserted portion of the connector does not need to be cylindrical. For example, each of the shape of the body portion and the shape of the inserted portion may be square tube-like. Moreover, the connector does not need to be a coaxial connector, and the connector may comprise a plurality of contacts. The contacts may be arranged, for example, in a pitch direction (lateral direction: the Y-direction). Moreover, the screws may be provided to the body portion and the inserted portion, respectively, or the screw may be provided to only one of the body portion and the inserted portion. Otherwise, no screw may be formed on each of the body portion and the inserted portion. In other words, the circumference surface of at least one of the body portion and the inserted portion may be formed of the screw. Moreover, the accommodation ditch may be formed for some purpose different from accommodation of the sealing member.

The present application is based on a Japanese patent application of JP2015-081118 filed before the Japan Patent Office on Apr. 10, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector attachable to a case formed with an insertion hole, the connector comprising a contact, a holding member, an outer member and an inserted portion, wherein:

the outer member is made of resin coated with a conductive plating layer;

the holding member holds the contact;

the outer member, at least in part, accommodates the holding member;

the inserted portion is configured to be inserted into the insertion hole rearward in a front-rear direction when the connector is attached to the case;

the outer member has a body portion, a flange and an attached surface;

the flange protrudes from the body portion in a perpendicular plane perpendicular to the front-rear direction;

the attached surface is formed of a rear surface of the body portion and a rear surface of the flange;

the inserted portion projects rearward beyond the attached surface and is located inward of the body portion in the perpendicular plane;

the rear surface of the body portion is formed with a pressure contact portion which surrounds the inserted portion with no break in the perpendicular plane;

the pressure contact portion is integrally formed on the rear surface of the body portion and is coated with the conductive plating layer that coats the outer member;

the pressure contact portion is formed with a contact surface which is coated with the conductive plating layer and is located rearward of the rear surface of the flange;

the inserted portion is formed with a space which passes through the inserted portion in the front-rear direction; and the contact is, at least in part, accommodated in the space.

2. The connector as recited in claim 1, wherein:

the inserted portion is formed integrally with the outer member; and the pressure contact portion is formed on a boundary between the rear surface of the body portion and the inserted portion in the perpendicular plane.

3. The connector as recited in claim 1, wherein:

the inserted portion is formed separately from the outer member; and the pressure contact portion is formed on an innermost part of the rear surface of the body portion in the perpendicular plane.

4. The connector as recited in claim 1, wherein the contact surface is perpendicular to the front-rear direction.

5. The connector as recited in claim 1, wherein the attached surface is formed with an accommodation ditch which surrounds the pressure contact portion with no break in the perpendicular plane.

6. The connector as recited in claim 5, wherein the accommodation ditch accommodates a sealing member.

7. The connector as recited in claim 1, wherein at least one of the body portion and the inserted portion has a circumference surface which is formed on a circumference in the perpendicular plane and formed with a screw.

8. A connector attachable to a case formed with an insertion hole, the connector comprising a contact, a holding member and an outer member, wherein:

the outer member is made of resin coated with a conductive plating layer;

the holding member holds the contact;

the outer member, at least in part, accommodates the holding member;

the outer member has a body portion, a flange, an inserted portion and a pressure contact portion;

the inserted portion is configured to be inserted into the insertion hole rearward in a front-rear direction when the connector is attached to the case;

the flange protrudes from the body portion in a perpendicular plane perpendicular to the front-rear direction;

the inserted portion projects rearward beyond a rear surface of the flange;

the body portion is located inward of the inserted portion in the perpendicular plane;

the pressure contact portion is formed on a boundary between the rear surface of the flange and the inserted portion in the perpendicular plane and surrounds the inserted portion with no break in the perpendicular plane;

the pressure contact portion is coated with the conductive plating layer that coats the outer member;

the pressure contact portion projects rearward beyond the rear surface of the flange and is formed with a contact surface which is coated with the conductive plating layer and is located rearward of the rear surface of the flange;

the inserted portion is formed with a space which passes through the inserted portion in the front-rear direction; and the contact is, at least in part, accommodated in the space.

9. The connector as recited in claim 8, wherein the contact surface is perpendicular to the front-rear direction.

10. The connector as recited in claim 8, wherein the rear surface of the flange is formed with an accommodation ditch which surrounds the pressure contact portion with no break in the perpendicular plane.

11. The connector as recited in claim 10, wherein the accommodation ditch accommodates a sealing member.

12. The connector as recited in claim 8, wherein at least one of the body portion and the inserted portion has a circumference surface which is formed on a circumference in the perpendicular plane and formed with a screw.

* * * * *